US007178935B2

(12) United States Patent
Ahsan et al.

(10) Patent No.: US 7,178,935 B2
(45) Date of Patent: Feb. 20, 2007

(54) STAR AND CRESCENT STRUCTURE AND METHOD THEREOF

(75) Inventors: Aziz Mohammad Ahsan, Hopewell Junction, NY (US); Sadaf Raoof Ahsan, Hopewell Junction, NY (US); Shahzad Saeed Ahsan, Hopewell Junction, NY (US)

(73) Assignee: Dinpanah, Inc., Hopewell Junction, NY (US)

( * ) Notice: Subject to any disclaimer, the term of this patent is extended or adjusted under 35 U.S.C. 154(b) by 414 days.

(21) Appl. No.: 10/313,724

(22) Filed: Dec. 6, 2002

(65) Prior Publication Data

US 2004/0109332 A1 Jun. 10, 2004

(51) Int. Cl.
*F21V 6/00* (2006.01)

(52) U.S. Cl. ..... 362/121; 362/84

(58) Field of Classification Search ..... 362/84, 362/260, 252, 806, 807, 808, 263, 121, 216; D99/25

See application file for complete search history.

(56) References Cited

U.S. PATENT DOCUMENTS

D61,416 S * 8/1922 Kronburger ..... D27/111
1,690,397 A * 11/1928 Boehland ..... 362/382
4,918,578 A * 4/1990 Thompson ..... 362/31
5,250,331 A * 10/1993 Grefalda ..... 428/11
6,192,610 B1 * 2/2001 Fallon et al. ..... 40/545
D479,763 S * 9/2003 Miller ..... D99/25
D483,920 S * 12/2003 Ahsan et al. ..... D99/25
2004/0078934 A1 * 4/2004 Feliz ..... 16/428

OTHER PUBLICATIONS http://web.archive.org/web20000229120931/http://www.al-azhar.ab.ca/, Al Azhar Shrine Home, Feb. 29, 2000, p. 1.*

Poughkeepsie Journal: Aziz M. Ahsan, Crescent-and-star show Muslim contributions, Dec. 17, 2001, Richard K. Wager, Margaretta A. Downey, p. 4a.*

George E Reedy, Zuhrah Temple, 1978, R & R Portraits, the cover shows a symbol including a crescent and star secured by a link.*

Muslim Symbol Gets Public Display. Islamic Society of North America Press Release. Dec. 2001.

Crescent-and-Star Show Muslim Contributions. Poughkeepsie Journal. p. 4A. Dec. 17, 2001.

* cited by examiner

*Primary Examiner*—Ali Alavi
(74) *Attorney, Agent, or Firm*—Aziz M. Ahsan; Ahsan & Associates, PLLC

(57) ABSTRACT

This invention related to a star and crescent structure and method thereof. More particularly it relates to a structure comprising a star which is secured to a crescent via at least one link, and method thereof.

36 Claims, 2 Drawing Sheets

STAR AND CRESCENT STRUCTURE AND METHOD THEREOF

FIELD OF INVENTION

This invention related to a star and crescent structure and method thereof. More particularly it relates to a structure comprising a star which is secured to a crescent via at least one link, and method thereof

BACKGROUND OF INVENTION

Different religious, cultural and social organizations have symbols and insignias to represent them. Muslims are in the process of adopting different symbols and insignias to represent them. Thus there is a need to invent symbols and insignias for the different Muslim communities.

PURPOSES AND SUMMARY OF THE INVENTION

The invention is a novel method and a star and crescent structure.

Therefore, one purpose of this invention is to provide a star and crescent structure and method thereof.

Another purpose of this invention is to provide a structure comprising a star which is secured to a crescent via at least one link, and method thereof.

Therefore, in one aspect this invention comprises a star which is secured to a crescent via at least one link, and method thereof.

BRIEF DESCRIPTION OF THE DRAWINGS

The features of the invention believed to be novel and the elements characteristic of the invention are set forth with particularity in the appended claims. The drawings are for illustration purposes only and are not drawn to scale. Furthermore, like numbers represent like features in the drawings. The invention itself, however, both as to organization and method of operation, may best be understood by reference to the detailed description which follows taken in conjunction with the accompanying drawings in which:

DETAILED DESCRIPTION

A star and crescent combination symbol has been invented to represent primarily the Muslims and secondarily any and all organization that would benefit from such an invention. The crescent and a star combination symbol could be used throughout the year, and especially during the holiday season.

ISNA (Islamic Society of North America) Secretary General Dr. Sayyid M. Syeed had said "This public display of the Muslim symbol alongside the symbols of Christianity and Judaism during the holiday season . . . is a much-needed recognition, especially when other major religions and their roles in the lives of Americans are being acknowledged."

Although the crescent and star does not have any religious significance or symbolism in Islam, it will be generally accepted as a public Muslim symbol, as the crescent moon has a central function in the Muslim lunar calendar as each month starts with the sighting of the new moon.

The star can be said to represent the 5 pillars of Islam: (1) the declaration of faith; (2) the duty to pray 5 times a day; (3) giving zakat, the annual charity; (4) fasting in the month of Ramadan; and (5) performance of Hajj, the pilgrimage. The 7 points in the symbol—5 from the star and 2 from the crescent moon—may be likened to represent the 7 articles of faith for the Muslims. They are belief in (1) Allah (God), (2) Angels, (3) God's Books—the Torah, the Bible, and the Qur'an, (4) God's Messengers—Adam to Moses to Jesus to Muhammad (peace be upon them all), (5) the Day of Resurrection, (6) Destiny, and (7) Life after Death. The color white is generally recognized to symbolize peace and purity, and the color green to represent prosperity and growth.

It should be stressed that the Muslim symbol adopted in the U.S. is not meant to be an embodiment of Islam per se, and Muslims around the world may envision other designs. It should also be noted that Islam prohibits the worship of symbols or representations of any worldly structures. ISNA has also stated that any Muslim symbol has no religious significance and only represents a national Muslim identity.

Figure 1:
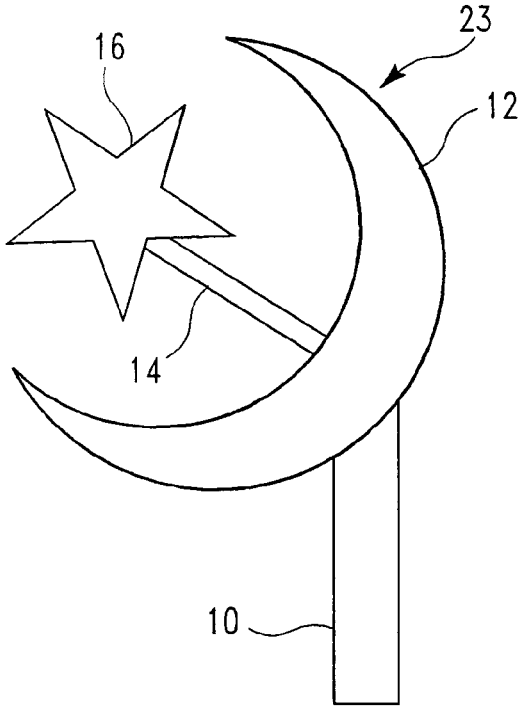
FIG. 1 illustrates a first embodiment of the invention.

FIG. 1 illustrates a first embodiment of the Muslim symbol invention 23. On a structure 10, a crescent 12 is secured. The crescent 12 has means to securely accommodate a linking structure 14. One end of the linking structure 14 is securely attached to the crescent 12, while the other end is secured to a five-point star 16. The color of the structure 10 is preferably green, while the color of the crescent 12 and the star 16 is white. The linking structure 14, can be of any color such as black, brown, to name a few. Preferably, a portion of the star 16 is within the inner radii of the crescent 12.

Figure 2:
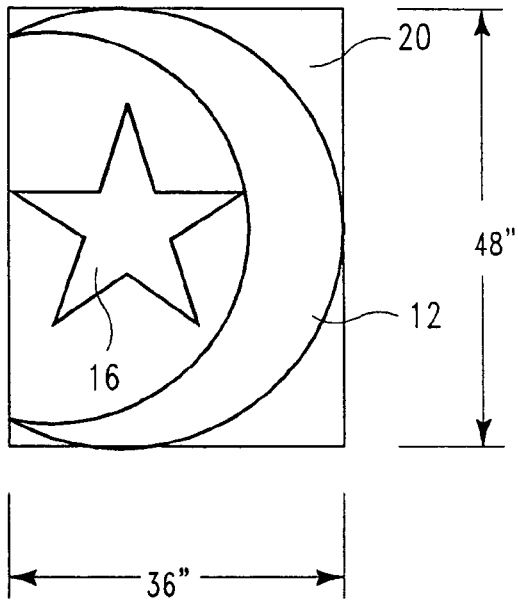
FIG. 2 illustrates a first method of making a crescent and a star.

FIG. 2 illustrates a first method of making the crescent 12 and the star 16. On a flat structure 20, such as, a piece of plywood, a wood panel, a metallic panel, a fiberglass panel, to name a few, preferably having a width of 36 inches and a length of 48 inches, the crescent 12 is first drawn. The five-pointed star 16 is then drawn within the area enveloped by the inner radii of the crescent 12. After both the crescent 12 and the star 16 have been marked the crescent 12 and the star 16 can be cut out of the panel structure 20 by methods well known in the art. For the ease of illustration only one flat structure 20 has been shown but it should be understood that a plurality of flat structures 20 can be underneath. Thus, a plurality of panel would yield a plurality of crescents 12 and stars 16 when the panels 20 are cut.

Figure 3:
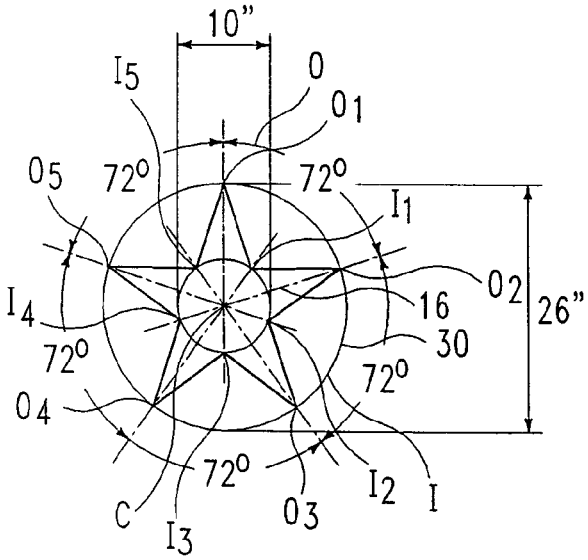
FIG. 3 illustrates a detailed method of making a star.

FIG. 3 illustrates a detailed method of making the star 16. From a center point C an outer radius of say 13 inches is drawn thus yielding a diameter of 26 inches for the outer circle O. An inner radius of say 5 inches is drawn from the same center point C, thus yielding a diameter of 10 inches for the inner circle I. A single point is chosen on the outer circle, say $O_1$ and from this single point $O_1$ four more points, such as, $O_2$, $O_3$, $O_4$ and $O_5$, are chosen on the outer circle O such that each point $O_1$, $O_2$, $O_3$, $O_4$ and $O_5$ are approximately 72 degrees away from the other point. A line is then drawn from each of the points on the outer circle $O_1$, $O_2$, $O_3$, $O_4$ and $O_5$, so that that line intersects the inner circle I at at least two different locations, thus creating points $I_1$, $I_2$, $I_3$, $I_4$ and $I_5$ on in inner circle. A line is then drawn from each of the intersecting points on the inner circle $I_1$, $I_2$, $I_3$, $I_4$ and $I_5$ to the closest points on the outer circle. Thus each intersecting point $I_1$, $I_2$, $I_3$, $I_4$ and $I_5$ on the inner circle will be connected to two different points on the outer circle, and this will result in a five-pointed star 16. The area between the inner circle I and the outer circle O that is outside of the connected lines is removed, such as, by cutting, and this will result in a stand alone five-pointed star 16.

Figure 4:
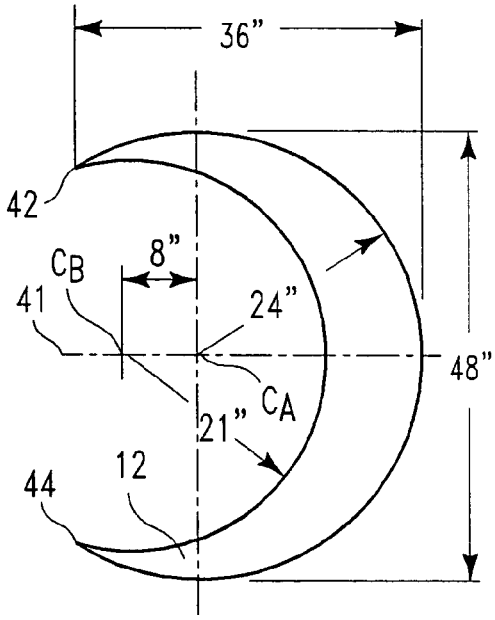
FIG. 4 illustrates a detailed method of making a crescent.

FIG. 4 illustrates a detailed method of making the crescent 12. Using a panel 20 as shown in FIG. 2, a line 41 bisecting the width is drawn. For this case, for a panel having, say a width of 36 inches and a length of say 48 inches will result in a line 41 that is at about 24 inches from the top and bottom edge. At a distance, such as, point $C_A$ a circle of say about 24 inches is drawn which would result in the outer edge of the crescent 12. Another circle of say 21 inches is drawn from a point $C_B$ along the bisecting line 41 at a distance of say about 8 inches away from the first circle point $C_A$ along the bisecting line. The inner and outer circles meet in an arc, having ends 42 and 44, thus creating a crescent 12. Areas exterior to the crescent 12 are removed thus resulting in a stand-alone crescent 12.

Figure 5:
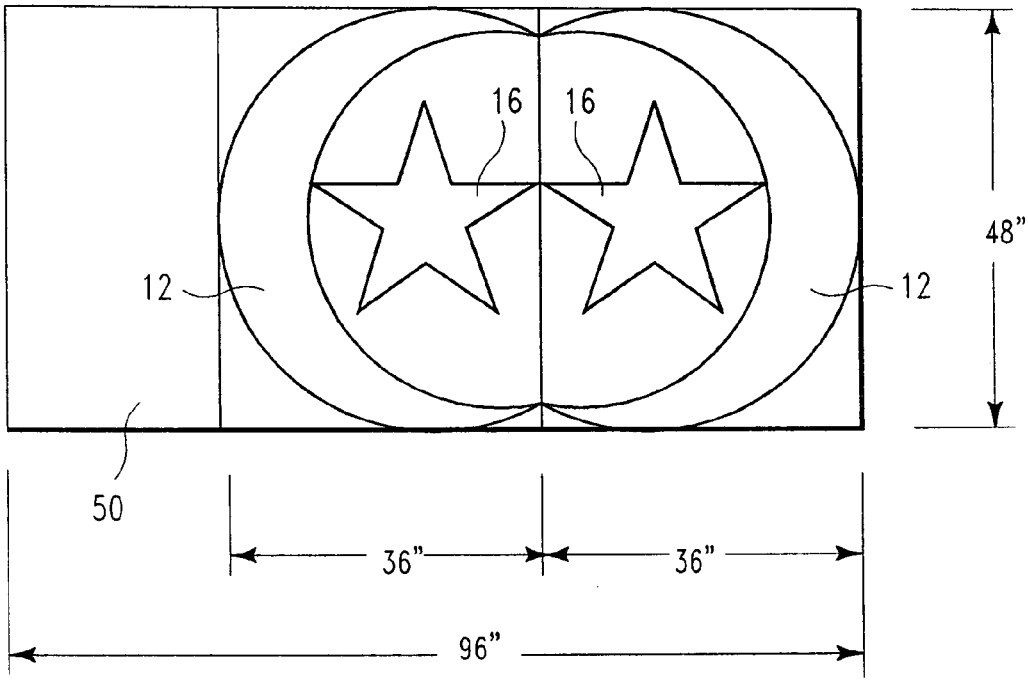
FIG. 5 illustrates a method of making plurality of crescents and stars.

FIG. 5 illustrates a method of making plurality of crescents and stars. On a larger panel 50, such as, a panel having a width of 48 inches and a length of 96 inches a plurality of stars 16 and crescents 12 can be obtained using the dimension discussed with reference to FIGS. 3 and 4.

Figure 6:
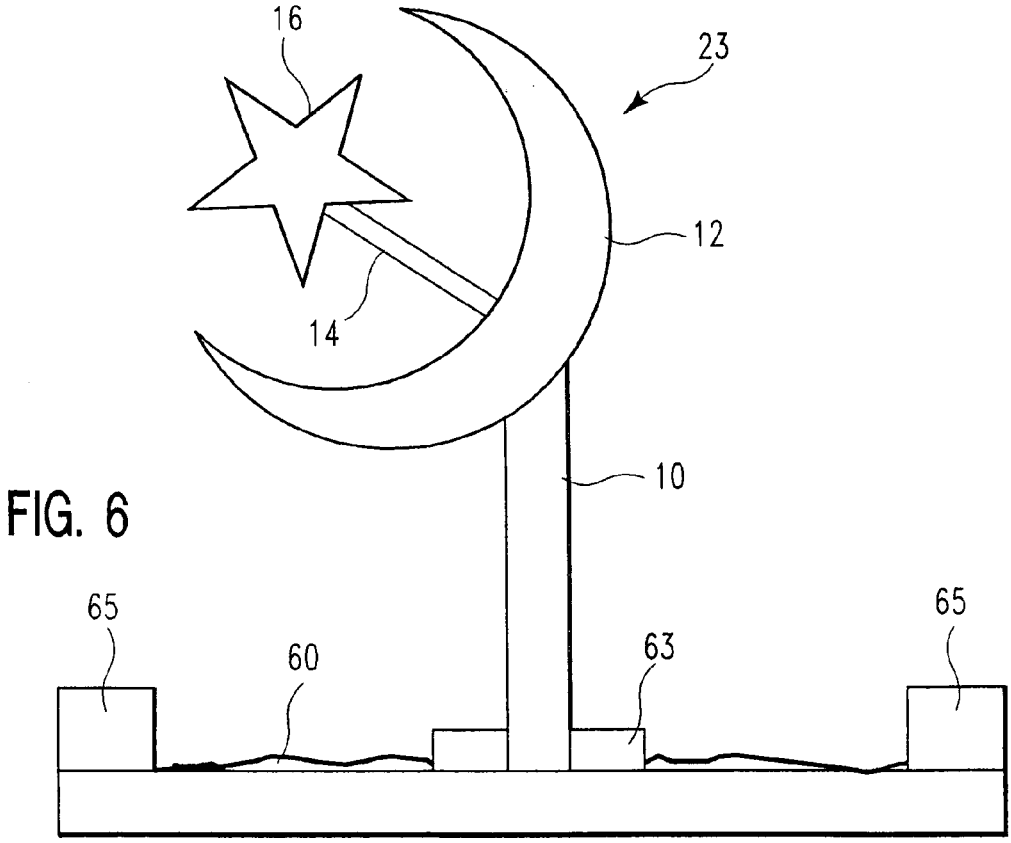
FIG. 6 illustrates a second embodiment of the invention.

FIG. 6 illustrates a second embodiment of the invention. The structure 10, having the star 16 secured to the crescent 12 with the link 14 is secured to another structure 63. The structure 63 could be the earth, a flat panel, a base, to name a few. In order to illuminate the Muslim symbol 23 at least one illumination device 65 is provided. The illumination device 65 can be secured to a separate base or a structure or could be secured to a portion of the structure 63. Electrical wires 60 could also be provided to provide power to the illumination device 65. The illumination device 65, could be selected from a group consisting of outdoor light, indoor light, flood light, halogen light, fog light, fiber optic light, to name a few.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A structure comprising a star secured to a crescent via at least one link, and wherein at least one illumination device illuminates said star and said crescent.

2. The structure of claim 1, wherein the star is a five-pointed star.

3. The structure of claim 1, wherein at least a portion of the star is within an inner radii of said crescent.

4. The structure of claim 1, wherein the link is secured to an outer edge of the star.

5. The structure of claim 1, wherein the link is secured to an inner edge of the crescent.

6. The structure of claim 1, wherein the link is secured to the back of the star.

7. The structure of claim 1, wherein the link is secured to the back of the crescent.

8. The structure of claim 1, wherein an elongated structure is secured to the crescent.

9. The structure of claim 8, wherein the opposite end of the elongated structure is secured to another structure.

10. The structure of claim 1, wherein an elongated structure is secured to the outer side of the crescent.

11. The structure of claim 1, wherein an elongated structure is secured to the back of the crescent.

12. The structure of claim 1, wherein said at least one illumination device is selected from a group consisting of outdoor light, indoor light, flood light, halogen light, fog light and fiber optic light.

13. A structure comprising a star secured to a crescent via at least one link, and wherein said structure is made in the form of said star and said crescent using flourescent tubing.

14. The structure of claim 13, wherein the star is a five-pointed star.

15. The structure of claim 13, wherein at least a portion of the star is within an inner radii of said crescent.

16. The structure of claim 13, wherein the link is secured to an outer edge of the star.

17. The structure of claim 13, wherein the link is secured to an inner edge of the crescent.

18. The structure of claim 13, wherein the link is secured to the back of the star.

19. The structure of claim 13, wherein the link is secured to the back of the crescent.

20. The structure of claim 13, wherein an elongated structure is secured to the crescent.

21. The structure of claim 20, wherein the opposite end of the elongated structure is secured to another structure.

22. The structure of claim 13, wherein an elongated structure is secured to the outer side of the crescent.

23. The structure of claim 13, wherein an elongated structure is secured to the back of the crescent.

24. A structure comprising a star secured to a crescent via at least one link, and wherein said structure is made in the form of said star and said crescent using neon tubing.

25. The structure of claim 24, wherein the star is a five-pointed star.

26. The structure of claim 24, wherein at least a portion of the star is within an inner radii of said crescent.

27. The structure of claim 24, wherein the link is secured to an outer edge of the star.

28. The structure of claim 24, wherein the link is secured to an inner edge of the crescent.

29. The structure of claim 24, wherein the link is secured to the back of the star.

30. The structure of claim 24, wherein the link is secured to the back of the crescent.

31. The structure of claim 24, wherein an elongated structure is secured to the crescent.

32. The structure of claim 24, wherein an elongated structure is secured to the outer side of the crescent.

33. The structure of claim 24, wherein an elongated structure is secured to the back of the crescent.

34. The structure of claim 31, wherein the opposite end of the elongated structure is secured to another structure.

35. The structure of claim 1, wherein said star is made from a material selected from a group consisting of plywood, wood panel, metallic panel and fiberglass panel.

36. The structure of claim 1, wherein said crescent is made from a material selected from a group consisting of plywood, wood panel, metallic panel and fiberglass panel.

* * * * *